US010024642B2

(12) United States Patent
Östlund et al.

(10) Patent No.: US 10,024,642 B2
(45) Date of Patent: Jul. 17, 2018

(54) INITIATING DEVICE AND METHOD FOR MANUFACTURING SUCH A DEVICE

(71) Applicant: SAAB AB, Linköping (SE)

(72) Inventors: Johan Östlund, Örebro (SE); Karl Edström, Kristinehamn (SE); Svante Persson, Karlskoga (SE)

(73) Assignee: SAAB AB, Linköping (SE)

( * ) Notice: Subject to any disclaimer, the term of this patent is extended or adjusted under 35 U.S.C. 154(b) by 0 days.

(21) Appl. No.: 15/120,894

(22) PCT Filed: Feb. 26, 2014

(86) PCT No.: PCT/SE2014/000023

§ 371 (c)(1),
(2) Date: Aug. 23, 2016

(87) PCT Pub. No.: WO2015/130198

PCT Pub. Date: Sep. 3, 2015

(65) Prior Publication Data

US 2016/0363427 A1 Dec. 15, 2016

(51) Int. Cl.
*F42C 19/02* (2006.01)
*F42C 19/08* (2006.01)
(Continued)

(52) U.S. Cl.
CPC ..... *F42C 19/02* (2013.01); *F42B 1/028* (2013.01); *F42B 33/025* (2013.01);
(Continued)

(58) Field of Classification Search
CPC ..... F42B 1/02; F42B 1/036; F42B 1/028
(Continued)

(56) References Cited

U.S. PATENT DOCUMENTS 2,974,595 A * 3/1961 Mohaupt ..... F42B 1/028 102/476
3,451,339 A 6/1969 Precoul
(Continued)

FOREIGN PATENT DOCUMENTS

DE 3316440 A1 4/1986
GB 1065244 A 4/1967

OTHER PUBLICATIONS

PCT/ISA/210—International Search Report—dated Dec. 5, 2014 (Issued in Application No. PCT/SE2014/000023).
(Continued)

*Primary Examiner* — Joshua E Freeman
(74) *Attorney, Agent, or Firm* — Venable LLP; Jeffri A. Kaminski

(57) ABSTRACT

An initiating device including at least one detonator, at least one booster charge and an action charge. The at least one booster charge is arranged such that, at the action charge initiates, the booster charge is free from disturbing edge effects that can have a disturbing effect on the action charge. A booster casing in which the booster charge is disposed is configured with a rear cylindrical part having a diameter $D_1$, a front conical part delimited by a first circular limit face having the diameter $D_1$, and a second circular limit face having a diameter $D_2$, wherein the two limit faces are plane-parallel at a distance $H_1$ from each other, wherein $H_1/D_2$ lies within a range 0.5-1.5. Also, a production method for producing the booster charge.

10 Claims, 2 Drawing Sheets

(51) Int. Cl.
*F42B 1/028* (2006.01)
*F42B 33/02* (2006.01)
*F42C 11/00* (2006.01)

(52) U.S. Cl.
CPC ..... *F42B 33/0207* (2013.01); *F42C 11/00* (2013.01); *F42C 19/08* (2013.01); *F42C 19/0803* (2013.01); *F42C 19/0807* (2013.01)

(58) Field of Classification Search
USPC ..... 42/307, 306
See application file for complete search history.

(56) References Cited

U.S. PATENT DOCUMENTS 3,611,939 A 10/1971 Stadler et al.
3,721,192 A * 3/1973 McEwan ..... F42B 1/02 102/306
3,880,080 A * 4/1975 Cook ..... F42B 1/04 102/318
4,331,081 A * 5/1982 Cloutier ..... C06B 23/001 102/286
4,901,619 A * 2/1990 Sassmannshausen .. F42B 1/024 102/306
4,982,665 A * 1/1991 Sewell ..... F42B 1/02 102/306
5,060,573 A * 10/1991 Montgomery ..... E21B 29/02 102/200
5,090,324 A * 2/1992 Bocker ..... F42B 1/032 102/307
6,487,971 B1 * 12/2002 Anderson ..... F42B 3/113 102/201
2003/0183113 A1 * 10/2003 Barlow ..... F42B 1/028 102/476
2006/0011278 A1 * 1/2006 Rezaie ..... C04B 1/0041 149/92
2008/0289529 A1 * 11/2008 Schilling ..... F42B 1/028 102/307
2009/0255431 A1 10/2009 Glatthaar et al.

OTHER PUBLICATIONS

PCT/ISA/237—Written Opinion of the International Searching Authority—dated Dec. 5, 2014 (Issued in Application No. PCT/SE2014/000023).
Extended Search Report issued in European Patent Application No. 14883920.2, dated Sep. 12, 2017.

* cited by examiner

INITIATING DEVICE AND METHOD FOR MANUFACTURING SUCH A DEVICE

CROSS-REFERENCE TO RELATED APPLICATIONS

The application is the national phase under 35 U.S.C. § 371 of PCT/SE2014/000023 filed 24 Feb. 2014.

FIELD OF THE INVENTION

The invention relates to a method and an apparatus for the manufacturing of composite material.

TECHNICAL FIELD

The present invention relates to an initiating device comprising a detonator and a booster charge, and to a production method for the said booster charge.

BACKGROUND AND PRIOR ART

Patent document DE3316440A1, FIG. 1, discloses an initiating device, comprising at least one detonator and at least one booster charge, for initiating an action charge, also referred to as an explosive charge.

A booster charge of traditional type is often divided into sections of different diameters. One problem is the edge effects caused by the diametrical transitions, which leads to an impaired explosive action. A further problem is differences in the density of the explosive between the different sections, which also leads to disturbances in the detonation front.

In the light of the above, there is a need to develop an initiating device having an improved booster charge which is free from disturbing edge effects, as well as a production method for the said booster charge.

OBJECT OF THE INVENTION AND ITS DISTINGUISHING FEATURES

A principal object of the present invention has therefore been to develop an initiating device comprising at least one detonator and at least one booster charge, wherein the initiating device, in the initiation of an explosive charge, is free from disturbing edge effects.

A further object of the present invention has been a production method for a booster charge.

The said objects, as well as other objects which have not been enumerated here, are satisfactorily met by virtue of that which is described herein.

Embodiments of the invention are defined in the dependent patent claims.

Thus, according to the present invention, an initiating device comprising at least one detonator and at least one booster charge has been provided, wherein the initiating device, in the initiation of an action charge, is free from disturbing edge effects.

Characteristic of the initiating device is that the booster charge is disposed in a booster casing comprising a cylindrical part having the diameter $D_1$ and a conical part delimited by a first circular limit face having the diameter $D_1$ and a second circular limit face having the diameter $D_2$, wherein the two limit faces are plane-parallel at the distance $H_1$ from each other and wherein $H_1/D_2$ lies within the range 0.5-1.5.

According to further aspects of the initiating device:

- the detonator comprises a primary explosive comprising silver azide,
- the booster charge comprises a secondary explosive comprising octogen,
- the action charge comprises a secondary explosive comprising octogen,
- the detonator is disposed in the direct vicinity of the cylindrical part of the booster charge via an air gap, and wherein the diameter D1 is at least equal to the critical diameter of the booster explosive,
- the secondary explosive of the booster charge is arranged in the booster casing with gradually increasing density, wherein the density is lowest in the cylindrical part of the booster casing and highest in the conical part of the booster casing, at the second limit face, wherein the lowest density is at the most equal to 80% of the theoretical density of the booster explosive and the highest density is at least equal to 95% of the theoretical density of the booster explosive,
- an action charge is a DEA charge, comprising a conical liner.

According to the present invention, a production method for a booster charge comprising a secondary explosive has also been provided, wherein the secondary explosive is disposed in a booster casing configured with a cylindrical part having the diameter D1 and with a conical part with a first circular limit face having the diameter D1 and with a second circular limit face having the diameter D2.

Characteristic of the production method is that the secondary explosive of the booster charge is arranged in the booster casing such that the density gradually increases, calculated from the cylindrical part of the booster casing to the conical part of the booster casing.

According to further aspects of the production method:

- the secondary explosive of the booster charge is loaded in the booster casing via a pressing process in a hydraulic press, wherein the pressing time and pressing force of the hydraulic press is adapted such that the density for the secondary explosive of the booster charge does not
- exceed 80% of the theoretical density of the explosive in the cylindrical part of the booster casing,
- fall below 95% of the theoretical density of the explosive in the conical part of the booster casing, at the second limit face.

ADVANTAGES AND EFFECTS OF THE INVENTION

The invention implies a number of advantages and effects, the most important being:

The conical booster means fewer disturbances on the detonation front upon initiation of a DEA charge, compared with traditionally configured boosters.

The conically configured booster has a wider field of application, which enables less use of variants.

The conically configured booster means that the explosive can easily be exchanged for a pyrotechnical composition, wherein the booster can be used to initiate powder charges.

The conically configured booster enables a simple production method, wherein the number of pressings can be reduced from normally five pressings to two or three pressings.

The conically configured booster enables a better utilization of the explosive by virtue of the fact that all explosive is used to create energy forward towards a main charge, which means that the quantity of explosive can be reduced. The lesser quantity of explosive thus means a lower product cost.

The simple conical form enables a simplified production method.

The invention shall now be described in somewhat greater detail in connection with the appended figure.

Further advantages and effects will emerge from a study and consideration of the following, detailed description of the invention with simultaneous reference to the appended drawing figure, in which.

DETAILED DESCRIPTION OF EMBODIMENTS

Figure 1:
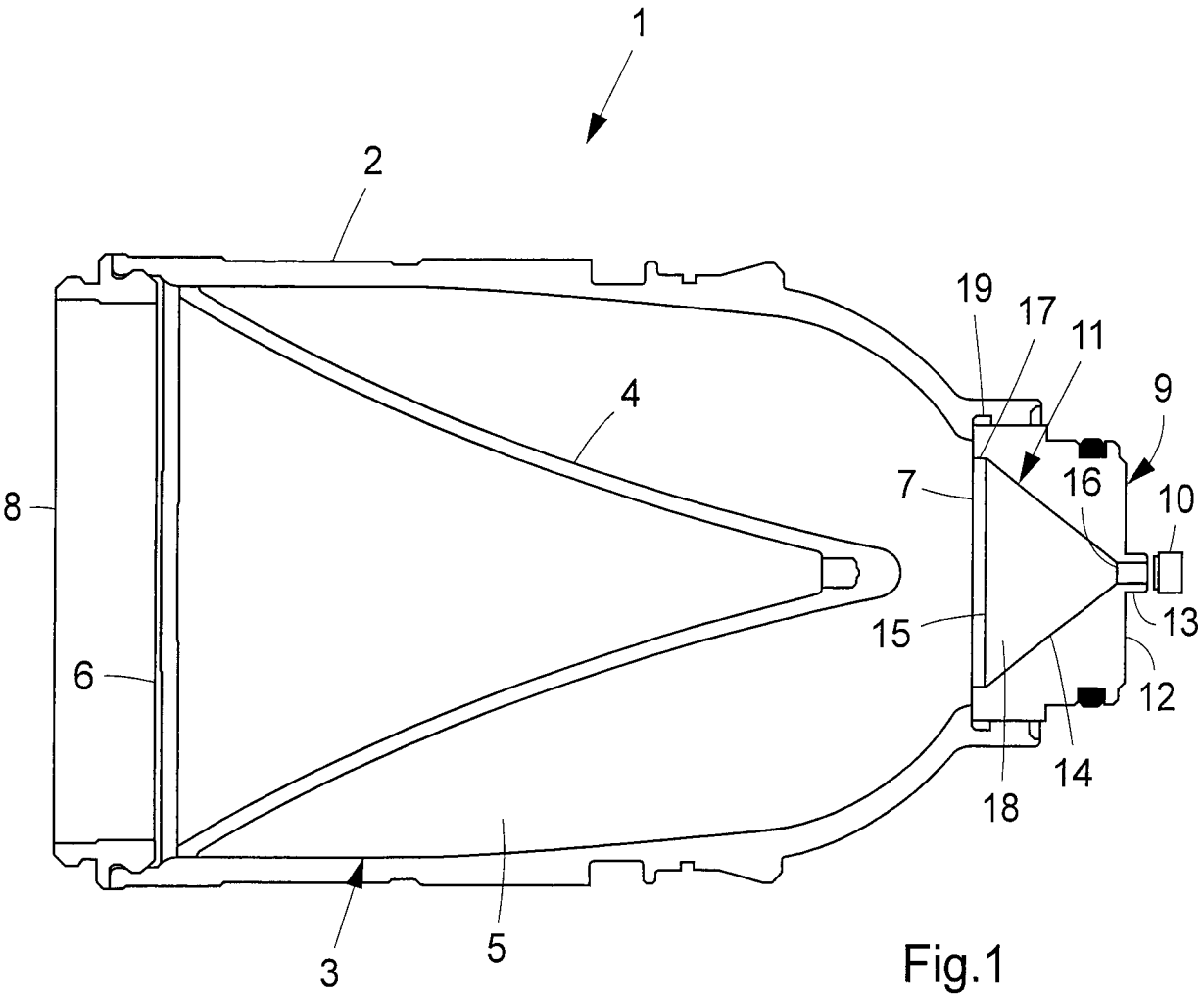
FIG. 1 shows schematically an action device comprising a detonator, a booster charge and an action charge of the DEA type.

In a preferred embodiment of the invention, FIG. 1, is shown an action device 1 comprising an action charge 3 disposed in an action container 2, wherein the action charge 3 is delimited by a front conical DEA liner and a rear initiating device 9. The conical DEA liner 4 and the initiating device 9 are mounted in the front and rear end faces 6, 7 respectively of the action container 2. The action container 2 is constituted, preferably, by a metal container of circular cross section. Also other configurations of the action container 2 can be used, for example comprising plastics or composite material.

To the front end face 6 of the action container 2, in front of the DEA liner 4, there is also fitted a detachable cover cap 8, also referred to as a tamping cap.

The foremost purpose of the cover cap 8 is to protect the DEA liner 4 from moisture and mechanical action.

The DEA liner 4 is, for example, of standard type, comprising copper. The base of the DEA cone 4 is fixedly mounted in the front end face 6 of the action container 2, wherein the tip of the DEA cone 4 is directed towards the booster charge 11. The base of the DEA cone 4 is fixed to the action container 2, preferably via a shrinkage process. Other mounting methods, too, are possible.

The initiating device 9 is mounted in the rear end face 7 of the action container 2, preferably via a threaded joint 19. Other types of joint, too, can possibly be used, such as, for example, screw, shrink, glue, or bolt joints.

The initiating device 9 comprises at least one detonator 10, also referred to as a detonating cap, and at least one booster charge 11, wherein the detonator 10 is disposed in the rear end face of the initiating device 9. The detonator 10 comprises a primary explosive, also referred to as a primer, and an electrode for initiation of the said primary explosive. The electrode comprises a plus pole, configured as a rod or pin, axially arranged in the detonator 10, and a minus pole, configured as a socket, arranged coaxially to the plus pole. The electrode can also be of conventional type. The detonator 10 and the booster charge 11 are preferably arranged in series with each other.

The detonator 10 is preferably of conventional type comprising a primary explosive based on, for example, silver azide ($AgN_3$) and/or potassium 4,6-dinitrobenzofuroxan (KDNBF).

The booster charge 11 is conically configured to eliminate or minimize the edge effects which normally occur as an effect of large or uneven diametrical transitions, cf. a wave in water which is broken around a breakwater. As a result of the conical configuration, an increased symmetry is realized in the detonation wave, which increases the effect in the action charge.

The conical booster charge 11 is disposed in a booster casing 14 comprising: a rear cylindrical part 13 having the diameter D1, an intermediate conical part 14, the rear end face of which is delimited by a first circular limit face 16 having the diameter D1 and the front end face of which is delimited by a second circular limit face 15 having the diameter D2, and a front cylindrical part 17 having the diameter D2 and the length H2.

The two limit faces 16 and 15, which are plane-parallel, lie at the distance H1 from each other, wherein H1/D2 shall lie within the range 0.5-1.5, or optimally at about 1.0.

The booster charge 11 expediently comprises a secondary explosive 18, preferably cyclotetramethylene-tetranitramine octogen (HMX or octogen), alternatively hexanitrodiphenylethylene (HNS). Also other types of secondary explosives 18 can possibly be used.

The action charge 3 comprises, preferably, a secondary explosive 5 of standard type, for example cyclotetramethylene-trinitramine (hexogen or RDX). Also other types of secondary explosives 5 can be included, for example cyclotetramethylene-tetranitramine octogen, also referred to as octogen or HMX, or alternatively, 2,4,6,8,10,12-hexanitrohexaazaisowurtzitane, also referred to as, or CL-20.

Figure 2:
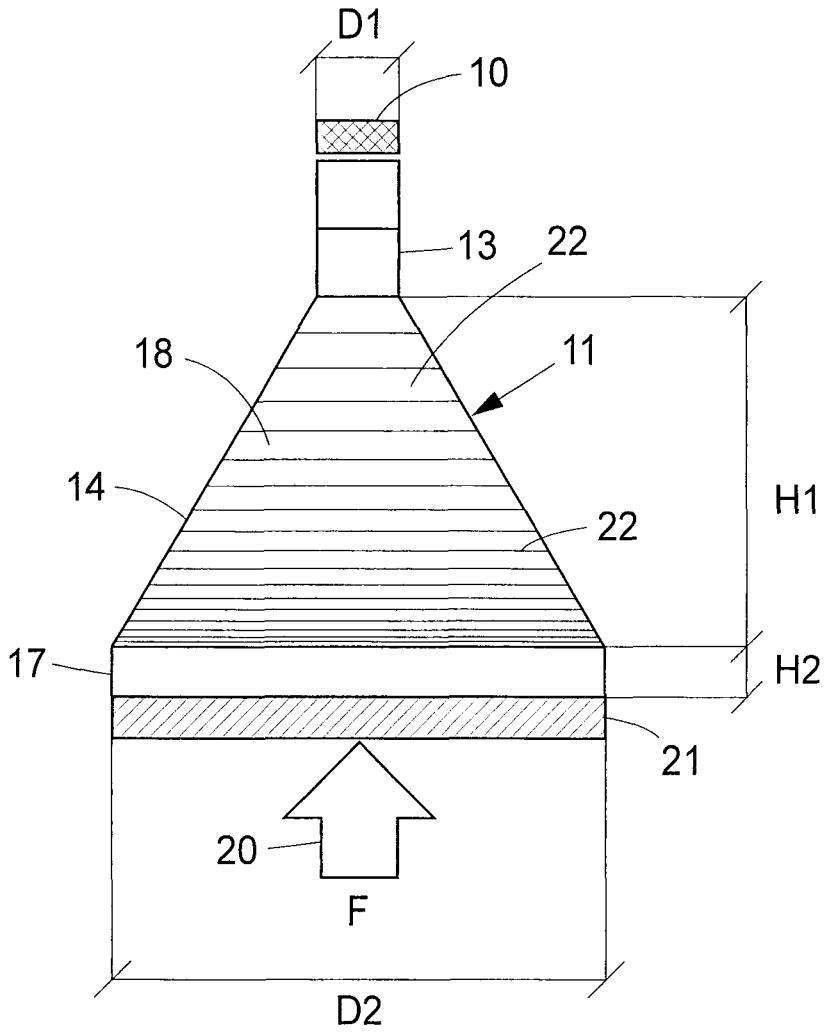
FIG. 2 shows schematically a production method for pressing a secondary explosive in a booster casing according to FIG. 1.

According to the invention, an improved production method for the booster charge 3 has been provided, according to FIG. 2. The production method means that the secondary explosive 18 of the booster charge 3 is loaded/pressed in the booster casing such that the explosive density gradually increases, calculated from the cylindrical part 13 of the booster casing to the conical part 14 of the booster casing, wherein the gradual density increase, FIG. 2, is symbolized by the distances between the lines 22.

The secondary explosive 18 of the booster charge 11 is loaded/pressed in the booster casing via a pressing process using a plunger or ram 21, wherein the ram 21, under the action of the force $F_p$ from a hydraulic press for a given time $F_t$, is pressed over a given distance, in the axial direction, into the booster casing, wherein the direction of the ram 21 is controlled by the front cylindrical part 17 of the booster casing. The conical form of the booster casing means that the density is higher in the front conical part of the booster casing 14, in which the diameter is greatest and in which the pressing force is applied, and lower in the rear sleeve-shaped part 13 of the booster casing, according to FIG. 2. The process is repeated two or more times until the desired density distribution has been achieved. A higher density in the front conical part 15 means a more powerful effect in the direction of action of the action part 3, at the same time as the lower density in the rear cylindrical part 13 of the booster casing makes the booster charge 11 easier to initiate.

Tests have shown that the pressing time $F_t$ and the pressing force $F_1$ have to be adapted such that the density of the explosive 18 in the rear cylindrical part 13 of the booster casing shall not exceed 80% of the theoretical density of the explosive 18, and that the density of the explosive 18 in the front conical part 14 of the booster casing shall not fall below 95% of the theoretical density of the explosive 18.

The use of the booster charge 11 is not limited to detonating action charges, but, by virtue of the fact that the explosive 18 in the booster charge 11 is replaced by a pyrotechnical composition of deflagrating type, can be used in illuminating shells and smoke shells, or in rocket motors.

The invention is not limited to embodiments shown, but can be varied in different ways within the scope of the patent claims.

The invention claimed is:

1. An initiating device, comprising:

at least one detonator comprising a primary explosive;

at least one booster charge comprising a secondary explosive;

an action charge, wherein the at least one booster charge is arranged such that, as the action charge initiates, the booster charge is free from disturbing edge effects that can have a disturbing effect on the action charge; and a booster casing in which the booster charge is configured with a rear cylindrical part having a diameter $D_1$, a front conical part delimited by a first circular limit face having the diameter $D_1$, and a second circular limit face having a diameter $D_2$, wherein the two limit faces are plane-parallel at a distance $H_1$ from each other and wherein $H_1/D_2$ lies within a range 0.5-1.5.

2. The initiating device according to claim 1, wherein the detonator comprises a primary explosive comprising silver azide.

3. The initiating device according to claim 1, wherein the booster charge comprises the secondary explosive comprising cyclotetramethylene-tetranitramine octogen (HMX).

4. The initiating device according to claim 1, wherein the action charge comprises a secondary explosive comprising cyclotetramethylene-tetranitramine octogen (HMX).

5. The initiating device according to claim 1, wherein the detonator is connected to the cylindrical part of the booster charge via an air gap, and wherein the diameter $D_1$ is equal to a diameter of the secondary explosive.

6. The initiating device according to claim 1, wherein the secondary explosive of the booster charge is arranged with a gradually increasing density in the booster casing, calculated from the rear cylindrical part to the front conical part, wherein the density, in the rear cylindrical part, is at most 80% of a theoretical density of said secondary explosive and, in the front conical part, is at least 95% of a theoretical density of said secondary explosive.

7. The initiating device according to claim 1, wherein the action charge is a directed explosive action (DEA) charge comprising a conical DEA liner.

8. A method for producing a booster charge comprising a secondary explosive, the method comprising:

loading the secondary explosive in a booster casing comprising a rear cylindrical part having a diameter $D_1$, a front conical part delimited by a first circular limit face having said diameter $D_1$, a second circular limit face having a diameter $D_2$, and loading the secondary explosive of the booster charge in the booster casing such that a density of the secondary explosive gradually increases, calculated from the rear cylindrical part of the booster casing to the front conical part of the booster casing.

9. The method according to claim 8, wherein the secondary explosive of the booster charge is loaded in the booster casing via a pressing process with a hydraulic press, wherein a pressing time $F_T$ and a pressing force $F_p$ are chosen such that a density of the secondary explosive does not exceed at most 80% of a theoretical density of the secondary explosive in a rear cylindrical part of the booster casing, is at least 95% of a theoretical density of the secondary explosive in the front conical part of the booster casing, at a second limit face.

10. An initiating device, comprising:

at least one detonator comprising a primary explosive;

at least one booster charge comprising a secondary explosive, wherein the booster charge is arranged such that, in the initiation of an action charge, said booster charge is free from disturbing edge effects which can have a disturbing effect on the action charge, wherein said booster charge is disposed in a booster casing configured with a rear cylindrical part having a diameter $D_1$, and a front conical part delimited by a first circular limit face having said diameter $D_1$ and a second circular limit face having a diameter $D_2$, wherein said first and second circular limit faces are plane-parallel at a distance $H_1$ from each other and wherein $H_1/D_2$ lies within the range 0.5-1.5, and wherein a secondary explosive of the booster charge is arranged with a gradually increasing density in the booster casing, calculated from the rear cylindrical part to the front conical part, wherein the density, in the rear cylindrical part, is at most 80% of the theoretical density of the secondary explosive and, in the front conical part, is at the least 95% of the theoretical density of the secondary explosive.

* * * * *